US005358420A

United States Patent [19]

Cairns et al.

[11] Patent Number: 5,358,420

[45] Date of Patent: Oct. 25, 1994

[54] PRESSURE RELIEF FOR AN ELECTRICAL CONNECTOR

[75] Inventors: Thomas M. Cairns, Beverly Hills, Mich.; William N. Moroney, Fairfield Glade, Tenn.

[73] Assignee: Ford Motor Company, Dearborn, Mich.

[21] Appl. No.: 72,020

[22] Filed: Jun. 7, 1993

[51] Int. Cl.[5] ..... H01R 4/60

[52] U.S. Cl. ..... 439/206; 439/271

[58] Field of Search ..... 439/190, 205, 206, 271, 439/272, 273, 274, 275, 276, 277

[56] References Cited

U.S. PATENT DOCUMENTS

| | | | |
|---|---|---|---|
| 3,678,432 | 7/1972 | Boliver | 439/206 X |
| 4,123,131 | 10/1978 | Pearce, Jr. et al. | 439/206 |
| 4,553,807 | 11/1985 | Cane | 439/206 X |
| 4,621,883 | 11/1986 | Noguchi . | |
| 4,637,674 | 1/1987 | Kobler . | |
| 4,874,325 | 10/1989 | Bensing et al. . | |
| 4,936,791 | 6/1990 | Zielinski et al. . | |
| 4,940,420 | 7/1990 | Munie . | |
| 5,104,253 | 4/1992 | Zielinski et al. . | |
| 5,114,359 | 5/1992 | Chishima et al. . | |
| 5,116,236 | 5/1992 | Colleran et al. | 439/271 |
| 5,248,263 | 9/1993 | Sakurai et al. | 439/271 |

*Primary Examiner*—Khiem Nguyen

*Attorney, Agent, or Firm*—Mark L. Mollon; Roger L. May

[57] ABSTRACT

An electrical connector assembly includes a first connector member, a second connector member, an interface seal disposed between the first and second connector members, and a structure for allowing gaseous fluid trapped between the first and second connector members to escape to atmosphere during the mating of the first and second connector members.

20 Claims, 3 Drawing Sheets

FIG 3
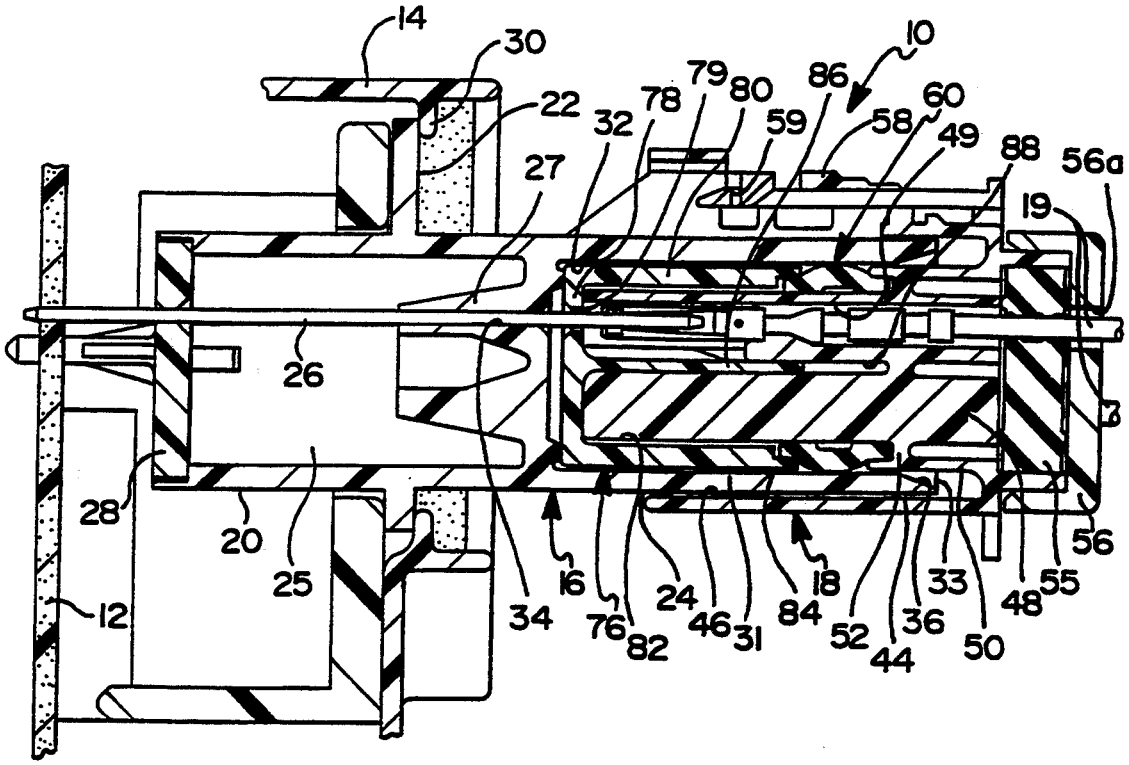
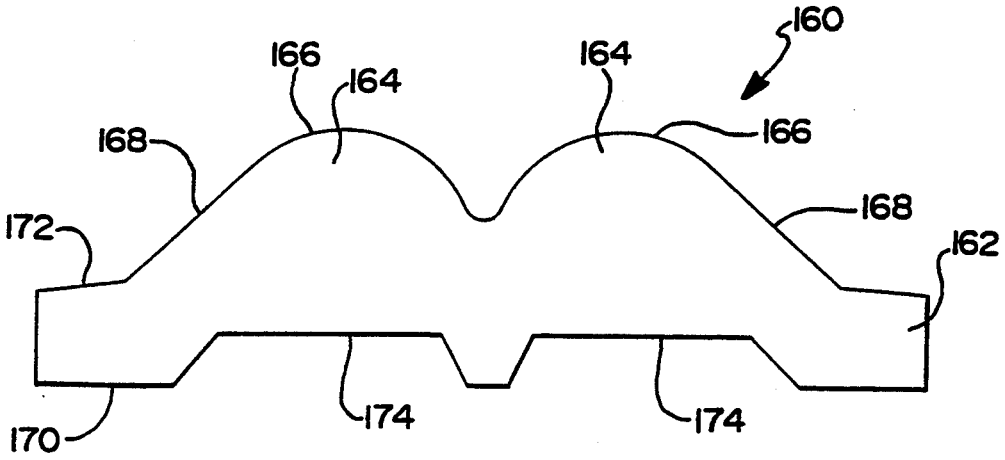
FIG 7

FIG 4
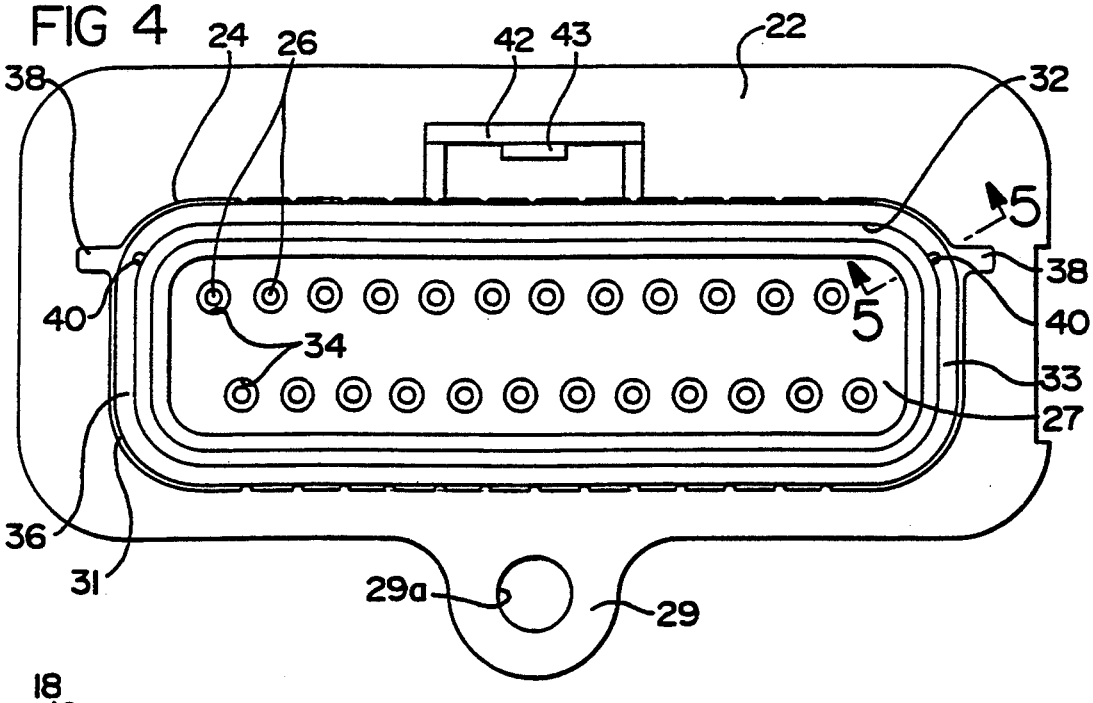
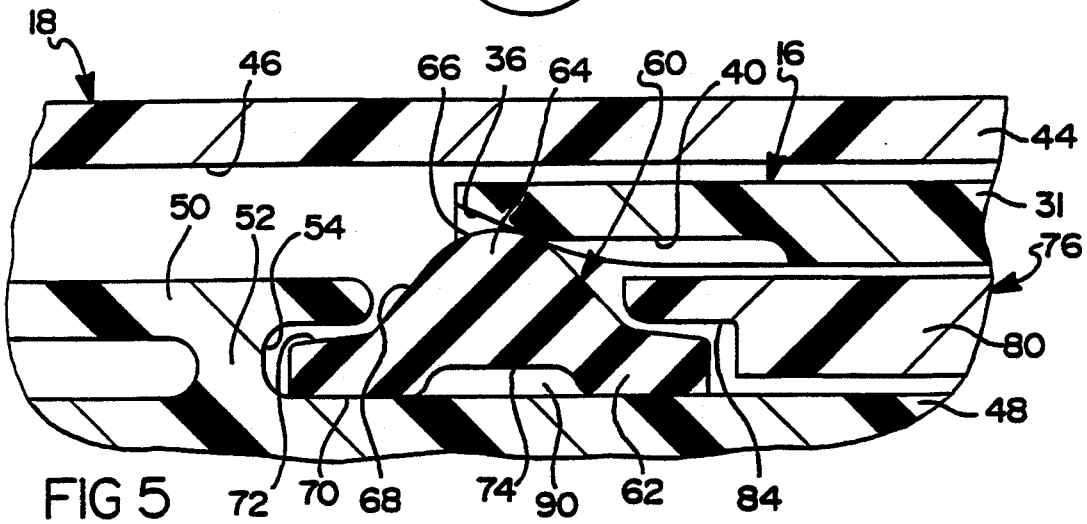
FIG 5
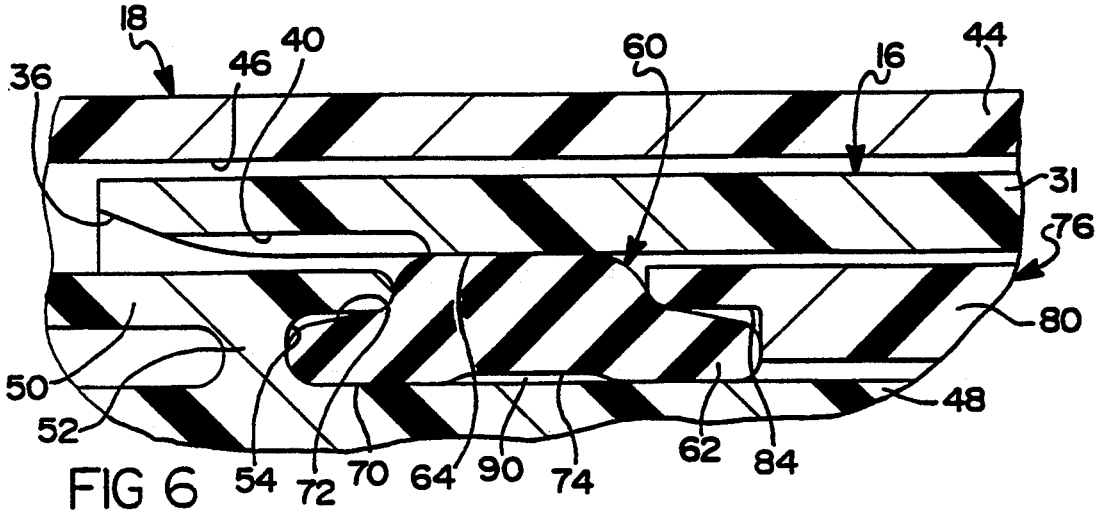
FIG 6

PRESSURE RELIEF FOR AN ELECTRICAL CONNECTOR

BACKGROUND OF THE INVENTION

1. Field of the Invention

The present invention relates generally to electrical connectors and, more specifically, to a pressure relief for an electrical connector.

2. Description of the Related Art

It is known to provide electrical connectors for connecting a plurality of electrical wires to a printed circuit board. Typically, the electrical connectors have a first connector member and a second connector member which are coupled together. The first connector member has a plurality of pins which pass into the printed circuit board and the second connector member has a plurality of electrical wires for connection with the pins. These electrical connectors are known to use a sealing member for sealing a joint between the coupled connector members.

One disadvantage of the above electrical connectors is that a volume of gaseous fluid such as air may be trapped between the connector members as the connector members are coupled together. As a result, an increased force is required to overcome the increase in internal pressure of the trapped air as one connector member moves into the other connector member. Another disadvantage of the electrical connectors is that the connector members have rectangular forward edges which contact the sealing member, thereby possibly dislodging the sealing member and not providing an adequate seal.

SUMMARY OF THE INVENTION

Accordingly, the present invention is an electrical connector assembly including a first connector member, a second connector member, and a sealing means disposed between the first and second connector members. Either one of the first or second connector members includes a relief means for allowing gaseous fluid trapped between the first and second connector members to escape to atmosphere during the mating of the first and second connector members One feature of the present invention is that the electrical connector assembly has a pressure relief for allowing trapped air between the connector members to escape or exit, thereby reducing the force required to mate or couple the connector members. Another feature of the present invention is that the electrical connector assembly has a feathered lead or forward edge on one of the connector members which contacts an interface seal and significantly reduces the potential for the mating connector member to dislodge the interface seal from its entrapment.

Other features and advantages of the present invention will be readily appreciated as the same becomes better understood after reading the subsequent description taken in conjunction with the accompanying drawings.

BRIEF DESCRIPTION OF THE DRAWINGS

FIG. 3 a sectional view of the electrical connector assembly of FIG. 1.

FIG. 4 is plan view of a connector member of the electrical connector assembly of FIG. 1.

FIG. 5 is a sectional view taken along line 5—5 of FIG. 4 illustrating pre-assembly of the electrical connector assembly.

FIG. 6 is a view similar to FIG. 4 illustrating post-assembly of the electrical connector assembly.

FIG. 7 is a sectional view of an alternate embodiment of an interface seal, according to the present invention, for the electrical connector assembly of FIG. 1.

DESCRIPTION OF THE PREFERRED EMBODIMENT(S)

Figure 1:
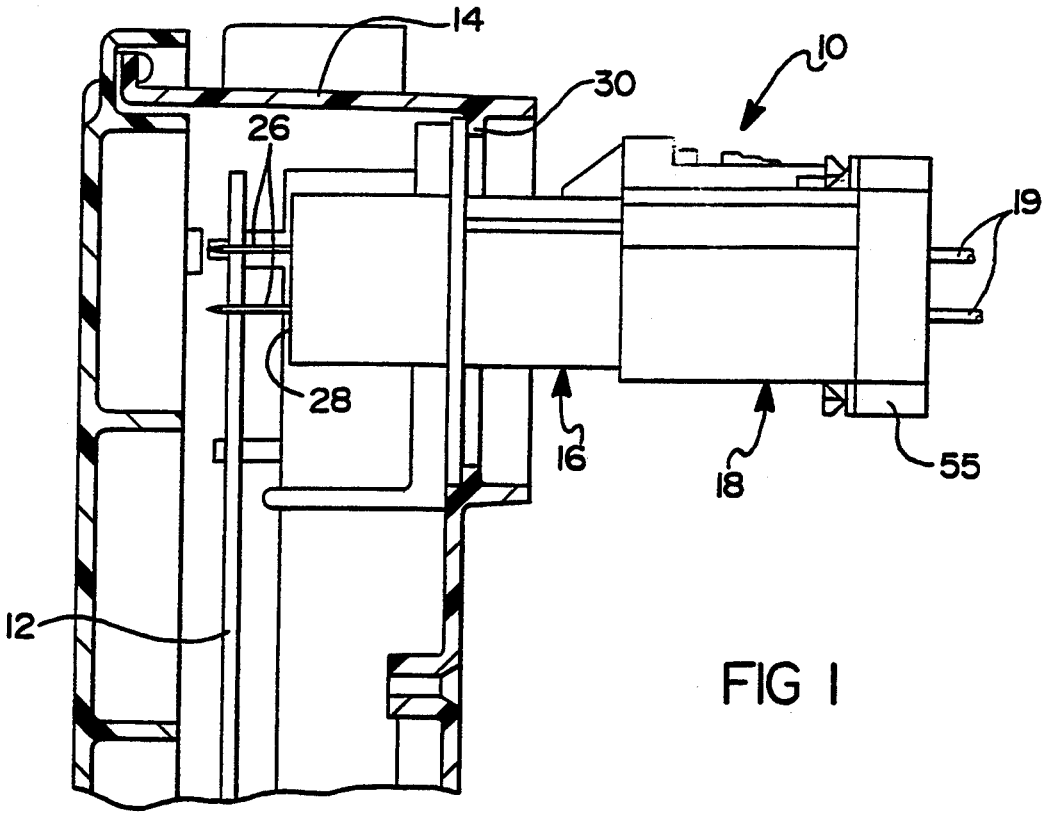
FIG. 1 is an elevational view of an electrical connector assembly, according to the present invention, illustrated in operational relationship with a printed circuit board.

Referring to the drawings and in particular to FIG. 1, an electrical connector assembly 10, according to the present invention, is illustrated in operational relationship with a printed circuit board 12 such as, for example, in a brake control module 14 for an automotive vehicle (not shown). The electrical connector assembly 10 includes a first connector member, generally indicated at 16, and a second connector member, generally indicated at 18, which mate or couple together to provide an electrical connection between a plurality of electrical wires 19 and the printed circuit board 12.

Figure 2:
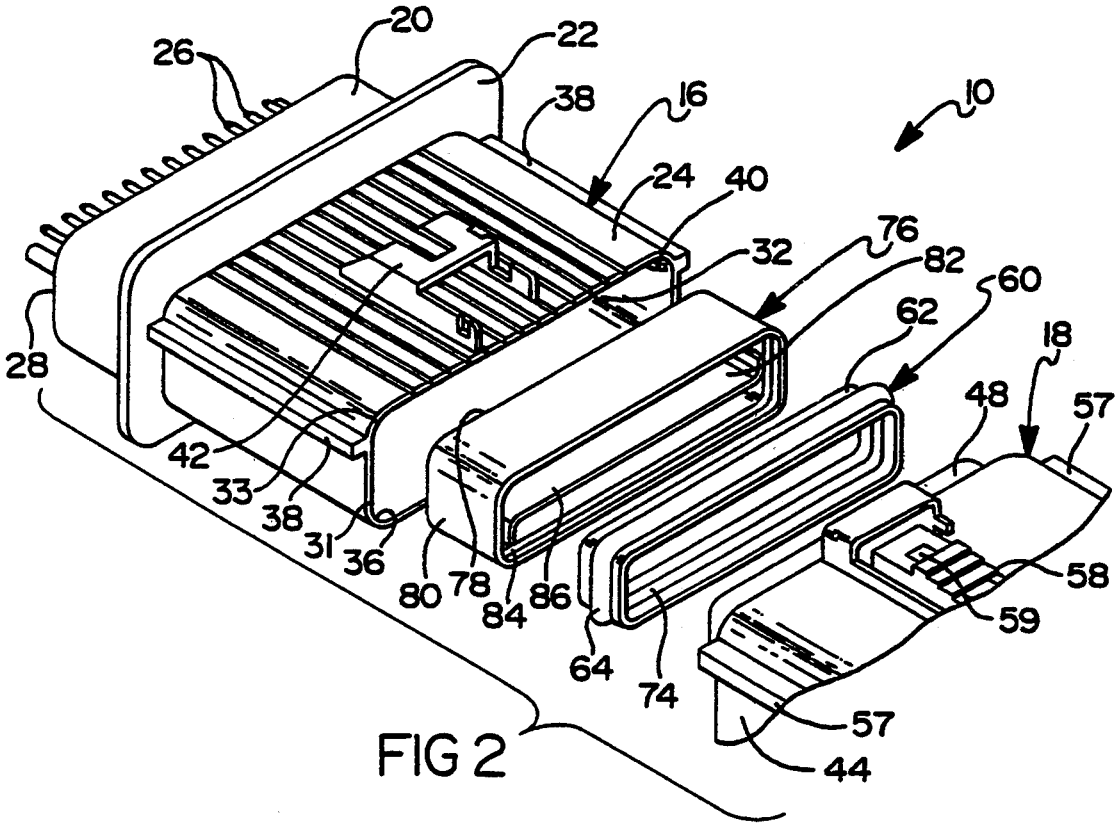
FIG. 2 is an exploded perspective view of the electrical connector assembly of FIG. 1.

Referring to FIGS. 1 through 3, the first connector member 16 extends longitudinally and has a base portion 20 at one end. The first connector member 16 also has a flange portion 22 extending radially at one end of the base portion 20. The first connector member 16 further has a connector portion 24 extending longitudinally from the flange portion 22 to the other end of the first connector member 16. It should be appreciated that the base portion 20, flange portion 22 and connector portion 24 are integral and formed as one piece from a plastic material.

The base portion 20 is generally rectangular in shape to form a hollow interior 25. The base portion 20 supports a plurality of connector pins 26 which extend longitudinally from an interior support member 27 within the hollow interior 25 of the base portion 20. The connector pins 26 pass through corresponding apertures in the printed circuit board 12. The base portion 20 may include an end cap 28 to close the hollow interior 25. It should also be appreciated that the connector pins 26 extend through corresponding apertures in the end cap 28.

Referring to FIGS. 2 through 4, the flange portion 22 is also generally rectangular in shape. The flange portion 22 may include at least one ear portion 29 extending radially outwardly and having an aperture **29*a* extending therethrough. As illustrated in FIGS. 1 and 3, the flange portion 22 may be disposed beneath a flange 30 of the brake control module 14 such that the connector portion 24 extends outwardly of the brake control module 14. The flange portion 22 may be secured to the brake control module 14 by suitable means such as a fastener (not shown) which extends through the aperture 29*a***.

The connector portion 24 has a wall 31 which is generally rectangular in shape to form a hollow interior or cavity 32 having an opening 33. The connector pins 26 extend through apertures 34 in the interior support member 27 and into the cavity 32. The connector portion 24 also includes a lead edge 36 at the opening 33 of the cavity 32. The lead edge 36 is feathered or beveled at an angle of approximately twenty-six degrees (26°) for a function to be described.

The connector portion 24 also has, at least one, preferably a pair of guide members 38 spaced from each other and extending longitudinally along an outer surface of the wall 31. The guide members 38 are generally rectangular in shape and integral with the wall 31 of the connector portion 24. The connector portion 24 also includes a pressure relief vent or groove 40 extending longitudinally along an interior surface of the wall 31 opposite each guide member 38. The pressure relief groove 40 is generally rectangular in shape and has a predetermined width such as 0.5 mm. Preferably, the width of the pressure relief groove 40 is less than a width of the guide member 38. The pressure relief groove 40 extends longitudinally from one end of the lead edge 36 a predetermined distance beginning 2.0 mm from the lead edge 36 and extending to 6.0 mm for a function to be described. The connector portion 24 further includes a first locking member 42 having a projection 43 disposed along one side of the outer surface of the wall 31 for a function to be described.

Referring to FIGS. 2 through 5, the second connector member 18 has a wall 44 which is generally rectangular in shape to form a hollow interior or first cavity 46. The second connector member 18 also has a center support wall 48 disposed in the first cavity 46 which is generally rectangular in shape and has, at least one, preferably a plurality of passageways 49 extending longitudinally therethrough. The connector member 18 further has a secondary wall 50 disposed in the first cavity 46 with an end portion connected to the wall 44. The secondary wall 50 is generally rectangular in shape and surrounds the support wall 48. The secondary wall 50 extends longitudinally parallel to the support wall 48. The secondary wall 50 is connected to the support wall 48 via a connecting wall 52 to form a seal recess 54 for a function to be described.

The second connector member 18 includes a grommet 55 and an end cap 56 connected to a rear portion of the secondary wall 50 to close the end of the second connector member 18. The end cap 55 has a plurality of apertures 56*a* for allowing the electrical wires 19 to extend into the passageways 49 for connection to the connector pins 26. It should be appreciated that the support wall 48, secondary wall 50 and connecting wall 52 are integral and formed as one piece from a plastic material.

The second connector member 18 also has a pair of channel members 57 spaced from each other and extending along an outer surface of the wall 44. The channel members 57 are generally rectangular in shape and integral with the wall 44 to form channels (not shown) to receive the guide members 38 of the first connector member 16. The second connector member 18 also includes a second locking member 58 disposed on one side of an outer surface of the wall 44 and having a locking aperture 59 to cooperate with the projection 43 on the first locking member 42. The second locking member 58 is attached to the outer surface of the wall 44 in a cantilevered manner and may be deflected toward the wall 44 to allow the locking aperture 59 to engage and disengage the projection 43 on the first locking member 42.

The electrical connector assembly 10 also includes an interface seal, according to the present invention and generally indicated at 60. The interface seal 60 has a base portion 62 extending longitudinally and annularly to form a generally rectangular shape. It should be appreciated that the interface seal 60 may have any suitable shape such as circular to match the shape of the connector members.

The interface seal 60 also has at least one bump or rib portion 64 extending radially from the base portion 62 and annularly therealong. The rib portion 64 has an arcuate apex surface 66 with inclined side surfaces 68 extending outwardly to the base portion 62 to form an outer or peripheral surface having a generally bell shape. The base portion 62 has a lower surface 70 which is generally planar or flat to contact the support wall 48. The base portion 62 also has an upper surface 72 which is inclined toward the arcuate apex surface 66 of the rib portion 64 to intersect the inclined side surface 68 of the rib portion 64.

The interface seal 60 further has at least one cavity 74 extending radially into the base portion 62 from the lower surface 70. The cavity 74 extends longitudinally and annularly along the base portion 62. The cavity 74 allows the base portion 62 to move or displace longitudinally as a result of a displacive force applied to the rib portion 64 as illustrated in FIGS. 5 and 6.

The interface seal 60 is made of an elastomer material such as a soft, inherently lubricated, silicone elastomer having a durometer of fifteen (15) to thirty-five (35) Shore A, preferably eighteen (18) Shore A. The interface seal 60 has an inner periphery three (3) to four (4) percent less than an outer periphery of the support wall 48. The interface seal 60 is disposed about the support wall 48 and positioned therealong such that one end of the base portion 60 is disposed in the seal recess 54.

The electrical connector assembly 10 further includes a sleeve, according to the present invention and generally indicated at 76. The sleeve 76 has an end wall 78 which is generally planar and rectangular in shape. The end wall 78 has a plurality of apertures 79 extending therethrough to receive the connector pins 26. The sleeve 76 also has a side wall 80 extending longitudinally from the end wall 78 to form a generally rectangular hollow interior or cavity 82. The side wall 80 has a seal recess 84 extending longitudinally and radially a predetermined distance from a free end thereof and is generally rectangularly in shape. The sleeve 76 also includes a locating member 86 extending longitudinally from an inner surface of the end wall 78 and into a cavity 88 of the support wall 48. The locating member 86 is disposed in the cavity 88 to locate the sleeve 76 relative to the support wall 48. The seal recess 84, support wall 48 and seal recess 54 cooperate to form a seal cavity 90 for the interface seal 60. The seal cavity 90 has a predetermined width greater than a predetermined width of the base portion 62 of the interface seal 60. For example, the seal cavity 90 may have a predetermined width of 8.0 mm and the base portion may have a predetermined width of 7.0 mm to allow for radial displacement or movement of the rib portion 64 and longitudinal displacement or movement of the base portion 62. It should be appreciated that the seal cavity 90 allows for displacement or movement of the interface seal 60 and the sleeve 76 entraps the interface seal 60, thereby providing positive retention of the interface seal 60.

Referring to FIG. 7, an alternate embodiment 160 of the interface seal 60 is shown. Like parts of the interface seal 60 have like reference numerals increased by one hundred (100). The interface seal 160 has a pair of the rib portions 164 connected to the base portion 162. The interface seal 160 also has a cavity 174 in the base portion 162 opposite each rib portion 164. The operation of the interface seal 160 is similar to the operation of the interface seal 60 to be described. It should be appreciated that the interface seal 160 may have more than two rib portions 164 and cavities 174 as required.

In operation, the interface seal 60 is disposed over the support wall 48 such that the lower surface 70 contacts the outer surface of the support wall 48 and is moved longitudinally such that one end of the base portion 62 is disposed in the seal cavity 54. The connecting wall 52 acts as a stop to locate the interface seal 60 and prevent further longitudinal movement toward the end cap 56. The sleeve 76 is disposed over the support wall 48 such that the locating member 86 is disposed in the cavity 88 of the support wall 48 and moved longitudinally until stopped by engagement between the end of the support wall 48 and the end wall 78. In this position, the other longitudinal end of the base portion 62 of the interface seal 60 is disposed in the seal recess 84. As illustrated in FIG. 5, the interface seal 60 is disposed in the seal cavity 90 with the longitudinal ends of the base portion 62 in the seal recesses 54 and 84 and the rib portion 64 extending radially past an outer surface of the secondary wall 50 and sleeve 76 in a preassembled state. The sleeve 76 acts as a stop to prevent longitudinal movement past the seal recess 84 and precludes rolling or twisting of the interface seal 60.

Next, the guide members 38 are orientated and disposed in the channel members 57. The first and second connector members 16 and 18 are moved longitudinally toward each other as illustrated in FIG. 5. The lead edge 36 tangentially contacts or engages the rib portion 64 of the interface seal 60 to apply a displacive force to the rib portion 64 to move radially the rib portion 64 toward the support wall 48. The lead edge 36 provides generally equal radial and longitudinal forces on the interface seal 60 to prevent the interface seal 60 from being dislodged from the seal cavity 90. As the wall 31 moves longitudinally and the rib portion 64 moves radially, the base portion 62 moves longitudinally to fill the space longitudinally in the seal cavity 90. Once this occurs, the rib portion 64 continues to move radially until it bottoms out and then deforms longitudinally as illustrated in FIG. 6.

As illustrated in FIG. 5, when the lead edge 36 contacts the interface seal 60, an initial volume of gaseous fluid such as air is trapped in the cavity 32 between the first and second connector members 16 and 18. As the wall 31 moves longitudinally over the rib portion 64, air trapped in the cavity 32 of the first connector member 16 is allowed to exit or escape through the pressure relief grooves 40. As illustrated in FIG. 6, the pressure relief groove 40 terminates longitudinally at the other side of the rib portion 64 to prevent contaminants such as fluid from entering past the interface seal 60 and into the cavity 32 of the first connector member 16. In this position, the electrical connector assembly 10 is in a post-assembly state with the projection 43 on the first locking member 42 disposed through the aperture 59 of the second locking member 58.

When the electrical connector assembly 10 is to be disconnected, the second locking member 58 is deflected downwardly toward the wall 44 such that the aperture 59 disengages the projection 43. The first and second connector members 16 and 18 are moved longitudinally away from each other. As this occurs, the pressure relief grooves 40 allow air to flow into the cavity 32 to reduce the disengagement force by limiting a vacuum or suction holding the connector members 16 and 18 together. Also, the rib portion 64 relaxes as a result of the displacive force being removed. Due to the cavity 74, the base portion 62 acts as a leaf spring and moves longitudinally and the rib portion 64 moves radially away from the support wall 48 to return to its original position. The sleeve 76 stops the interface seal 60 from longitudinal movement and prevents dislodgement of the seal 60 from the seal cavity 90.

Accordingly, the first connector member 16 has a lead edge 36 on the wall 31 which is feathered or beveled to provide tangential contact with the rib portion 64 of the interface seal 60, thereby reducing the potential for the first connector member 16 to dislodge the interface seal 60 from the seal cavity 90. The first connector member 16 also includes pressure relief grooves 40 to allow trapped air in the cavity 32 to escape to atmosphere as the connector members 16 and 18 are coupled together. As a result of the relief of air pressure, by the pressure relief grooves 40, the force required to couple the connector members 16 and 18 is significantly reduced, for example, from forty (40) pounds to three (3) pounds.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An electrical connector assembly comprising:

a first connector member;

a second connector member;

sealing means disposed between said first and second connector members; and one of said first and second connector members including relief means for allowing gaseous fluid trapped between said first and second connector members to escape to atmosphere during the mating of said first and second connector members and for preventing gaseous fluid from entering past said sealing means and into said first and second connector members when mated together.

2. An electrical connector assembly as set forth in claim 1 wherein said relief means comprises at least one groove extending longitudinally along an inner surface of the one of said first and second connector members.

3. An electrical connector assembly as set forth in claim 1 wherein said relief means comprises a pair of grooves spaced laterally and extending longitudinally along an inner surface of the one of said first and second connector members.

4. An electrical connector assembly as set forth in claim 2 including at least one guide member extending longitudinally along an outer surface of the one of said first and second connector members and at least one channel extending longitudinally along the other of said first and second connector members, said at least one guide member being disposed in said at least one channel to orientate and guide said first and second connector members relative to each other.

5. An electrical connector assembly as set forth in claim 4 wherein said at least one groove has a width less than a width of said at least one guide member.

6. An electrical connector assembly as set forth in claim 2 wherein said at least one groove has a predetermined width and a predetermined length.

7. An electrical connector assembly as set forth in claim 1 wherein the one of said first and second connector members has a leading edge which is beveled.

8. An electrical connector assembly as set forth in claim 7 wherein said leading edge is beveled at an angle of approximately twenty-six degrees.

9. An electrical connector assembly as set forth in claim 7 wherein said relief means comprises at least one groove extending axially a predetermined distance from said leading edge along an inner surface of the one of said first and second connector members.

10. An electrical connector assembly comprising:

a first connector member;

a second connector member;

an interface seal disposed between said first and second connector members; and at least one groove extending longitudinally along an inner surface of one of said first and second connector members for allowing gaseous fluid trapped between said first and second connector members to escape to atmosphere during the mating of said first and second connector members and terminating prior to the other side of said interface seal to prevent gaseous fluid from entering past said interface seal and into said first and second connector members when mated together.

11. An electrical connector assembly as set forth in claim 10 including a plurality of grooves spaced laterally and extending longitudinally along an inner surface of the one of said first and second connector members.

12. An electrical connector assembly as set forth in claim 10 including at least one guide member extending longitudinally along an outer surface of the one of said first and second connector members and at least one channel extending longitudinally along the other of said first and second connector members, said at least one guide member being disposed in said at least one channel to orientate and guide said first and second connector members relative to each other.

13. An electrical connector assembly as set forth in claim 12 wherein said at least one groove has a width less than a width of said at least one guide member.

14. An electrical connector assembly as set forth in claim 12 wherein said at least one groove has a predetermined width and a predetermined length.

15. An electrical connector assembly as set forth in claim 10 wherein the one of said first and second connector members has a leading edge which is beveled to tangentially contact said interface seal.

16. An electrical connector assembly as set forth in claim 15 wherein said at least one groove extends longitudinally a predetermined distance from said leading edge along an inner surface of the one of said first and second connector members.

17. An electrical connector assembly as set forth in claim 15 wherein said leading edge is beveled at a predetermined angle to produce a substantially equal radial and longitudinal force on said interface seal.

18. An electrical connector assembly comprising:

a first connector member;

a second connector member;

an interface seal disposed between said first and second connector members;

a plurality of grooves spaced laterally and extending longitudinally along an inner surface of one of said first and second connector members for allowing gaseous fluid trapped between said first and second connector members to escape to atmosphere during the mating of said first and second connector members;

the one of said first and second connector members having a leading edge which is beveled to tangentially contact said interface seal; and said grooves extending longitudinally a predetermined distance from said leading edge along an inner surface of the one of said first and second connector members and terminating prior to the other side of said interface seal to prevent gaseous fluid from entering past said interface seal and into said first and second connector members when mated together.

19. An electrical connector assembly as set forth in claim 18 wherein said leading edge is beveled at a predetermined angle to produce a substantially equal radial and longitudinal force on said interface seal.

20. An electrical connector assembly as set forth in claim 19 wherein said predetermined angle is about approximately twenty-six degrees.

* * * * *